United States Patent [19]

Stanley

[11] 3,955,253

[45] May 11, 1976

[54] STRAND TREATMENT APPARATUS

[75] Inventor: Robert K. Stanley, Media, Pa.

[73] Assignee: Textured Yarn Co., Kennett Square, Pa.

[22] Filed: Oct. 31, 1974

[21] Appl. No.: 519,519

Related U.S. Application Data

[63] Continuation-in-part of Ser. No. 405,262, Oct. 11, 1973, Pat. No. 3,896,529, which is a continuation-in-part of Ser. Nos. 343,644, March 22, 1973, Pat. No. 3,840,950, and Ser. No. 376,890, July 5, 1973, and a continuation-in-part of Ser. No. 124,213, March 15, 1971, Pat. No. 3,753,275, which is a continuation-in-part of Ser. No. 822,429, May 7, 1969, Pat. No. 3,570,083, which is a continuation-in-part of Ser. No. 678,428, Oct. 26, 1967, Pat. No. 3,462,814, and Ser. No. 302,758, July 31, 1963, Pat. No. 3,376,622.

[52] U.S. Cl. ..... 28/1.3; 28/1.4; 28/1.6

[51] Int. Cl.[2] ..... D02G 1/20

[58] Field of Search ..... 28/1.3, 1.4, 1.6, 72.14; 239/590.3

[56] References Cited

UNITED STATES PATENTS

| | | | |
|---|---|---|---|
| 2,575,838 | 11/1951 | Rainard | 28/72.14 X |
| 2,575,839 | 11/1951 | Rainard | 28/72.14 |
| 2,914,835 | 12/1959 | Slayter et al. | 28/1.3 X |
| 3,046,633 | 7/1962 | Ohashi et al. | 28/1.6 |
| 3,078,047 | 2/1963 | Enemark | 239/590.3 X |
| 3,298,079 | 1/1967 | Agett et al. | 28/72.14 |
| 3,343,240 | 9/1967 | Parmeggiani et al. | 28/1.3 |
| 3,389,445 | 6/1968 | Schreffler | 28/1.3 |
| 3,570,084 | 3/1971 | Stanley et al. | 28/72.14 |
| 3,650,001 | 3/1972 | Nikkel | 28/1.6 |
| 3,703,754 | 11/1972 | Blanc | 28/72.14 |
| 3,763,525 | 10/1973 | MacKnight | 28/1.3 |
| 3,832,759 | 9/1974 | Eskridge | 28/1.3 |

*Primary Examiner*—Louis K. Romrodt
*Attorney, Agent, or Firm*—Charles A. McClure

[57] ABSTRACT

Textile strands are crimped by feeding them into and forwarding them within a laterally confining region that terminates in a laterally surrounding fine screen with a flared outlet end. The resulting strand-crimping apparatus or stuffer-crimper type utilizes flow of injected fluid to forward or assist in forwarding the crimped strand therethrough.

6 Claims, 6 Drawing Figures

STRAND TREATMENT APPARATUS

This application is a continuation-in-part of my copending patent application, Ser. No. 405,262 filed Oct. 11, 1973 now U.S. Pat. No. 3,896,529, granted July 29, 1975, which was a continuation-in-part of my copending applications Ser. No. 343,644 filed Mar. 22, 1973, now U.S. Pat. No. 3,840,950 granted Oct. 15, 1974, and Ser. No. 376,890 filed July 5, 1973, the latter of which was a continuation-in-part of the former and of Ser. No. 124,213 filed Mar. 15, 1971, now U.S. Pat. No. 3,753,275, granted Aug. 21, 1973, which was a continuation-in-part of Ser. No. 822,429 filed May 7, 1969 and now U.S. Pat. No. 3,570,083, itself a continuation-in-part of my prior applications, Ser. No. 678,428 filed Oct. 26, 1967 (now U.S. Pat. No. 3,462,814) and Ser. No. 302,758 filed July 31, 1963 (now U.S. Pat. No. 3,376,622).

This invention relates to longitudinally compressive or stuffer crimping of textile strands, especially with the aid of an injected fluid to forward or aid in forwarding the strand within a laterally confining region wherein it is compressively crimped.

Numerous means and methods of bulking or crimping textile strands are well known, one of them being compressive or stuffer crimping, in which strands are fed longitudinally into a laterally confining region through which their passage is retarded sufficiently to result in buckling of incoming strands into crimped configuration. Injected fluid has been used to forward or assist in forwarding strands for compressive crimping therein but with some attendant difficulties, especially at or approaching the outlet end of the lateral confinement. The fluid force may not be dissipated smoothly enough to provide suitable strand transition from confinement to the exterior and may occasion undesirable configurational irregularities in the crimped strand. Such apparatus may be combined with strand-drawing apparatus to constitute a draw-crimper.

A primary object of the present invention is improved longitudinally compressive crimping of textile strands.

Another object is stuffer-crimping of textile strands without formation of undesired jet-induced strand configurations or degradation from excessive lateral compression or subsequent expansion.

A further object is provision of strand-crimping apparatus for accomplishing the foregoing objects.

Other objects of this invention, together with means and methods for attaining the various objects, will be apparent from the following description and the accompanying diagrams of a preferred embodiment and a modified embodiment thereof, which are presented by way of example rather than limitation.

In general, the objects of the present invention are accomplished, in textile strand-crimping apparatus having an entrance and an exit and means laterally confining such strand for forwarding therebetween and means for injecting fluid for use in forwarding the strand, and including an outwardly flared screen at the exit, which is open or closure-free.

Figure 1:
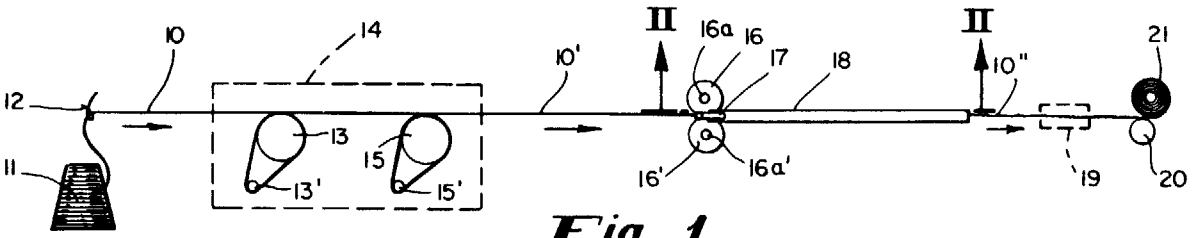
FIG. 1 is a schematic representation of strand treatment utilizing apparatus according to the present invention.

FIG. 1 shows strand 10 as being withdrawn from package 11 thereof and forwarded through guide 12 to first pair 13, 13' and then second pair 15, 15' of godet and separator rolls within enclosure 14. The enclosure may be heated, as may the godets themselves, which also may draw the strand therebetween to increased length. Upon leaving the enclosure, the strand (now designated 10') passes through the nip of pair of rolls 16, 16' mounted on axles **16*a*, 16*a*', and into the entrance of nip-jet stuffer-crimper 18. Tube 17 (partly broken away) extends obliquely into the crimper wall and receives air thereinto and onto the strand just downstream of the roll nip. Crimped strand 10'' is withdrawn lengthwise from the exit end of the crimper through region 19, in which it is adjusted in tension, speed, or temperature (or a combination thereof) and then is shown as being wound into package 21 by drive roll 20,** which may be slotted helically to traverse the strand onto the package.

Figure 2:
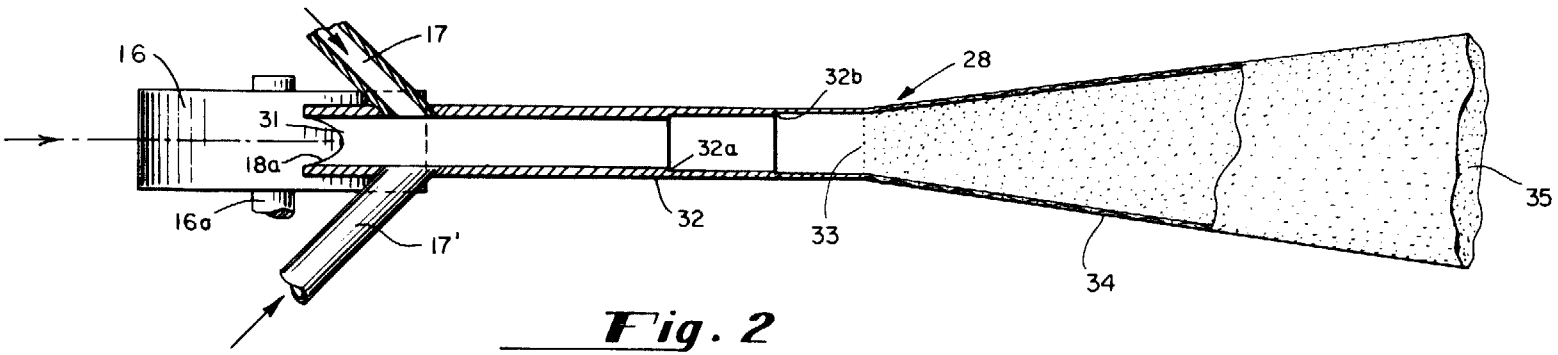
FIG. 2 is an enlarged side elevation, largely in section along II—II in FIG. 1, of certain of such apparatus, less the strand shown in that preceding view.

FIG. 2 shows nip-jet stuffer-crimper 28 of the present invention largely resembling that of the preceding view but in greater detail, including tubular entrance portion 31, exit portion 34, and intermediate portion 32 joining the entrance and exit portions. Feed roll 16 protruding leftward beyond beveled end **18*a* of the entrance portion, which is beveled to fit within the bight of the rolls, nearly to the nip, is visible because roll 16' is absent from this view. Extending obliquely to one another and to the downstream direction of strand travel are pair of fluid inlet tubes 17, 17' communicating with entrance portion 31** at angles of about 30° below and above the horizontal immediately downstream from the entrance end. No attempt is made in this schematic view to show the flaring or the foraminous nature of the outlet end of the laterally confining or stuffing chamber.

The bore of the intermediate portion of the chamber in this embodiment of stuffer crimper of this invention is shown stepped outwardly in the downstream direction (to the right) at **32*a* and 32*b*. Exit portion 34 flares smoothly outward and has small openings therethrough (indicated here by stippling) throughout its length, from junction 33 with the intermediate portion to chamber outlet 35 (shown broken away). The exit portion is screenlike in function and structure and sometimes is called a "screen" herein notwithstanding that it may or may not be woven in form. The strand shown in FIG. 1 is omitted from FIG. 2** in the interest of clarity but is shown again in the fregmentary enlarged views following.

Figure 3:
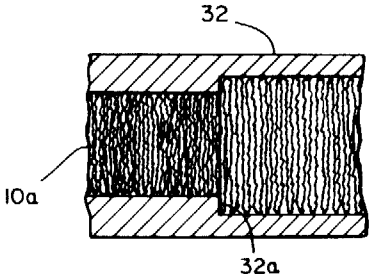
FIG. 3 is a fragmentary view of part thereof with the strand in place, on a further enlarged scale.
Figure 4:
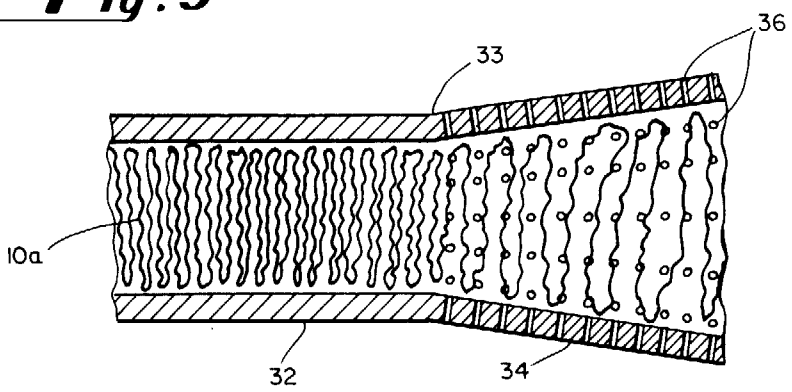
FIG. 4 is a similar fragmentary view of another part thereof.

FIG. 3 shows part of stuffing chamber intermediate portion 32 flanking step **32*a* and filled with compact strand accumulation 10*a* (shown stylized). FIG. 4 shows parts of intermediate portion 32 and flaring exit portion 34 flanking junction 33 therebetween. Openings 36 through the wall of the exit portion from the interior to the exterior are visible (not necessarily drawn to scale) in this view, and the strand accumulation therein becomes less compact in the exit direction. Further downstream (not shown) crimped strand 10'' is withdrawn longitudinally from the exit portion for any subsequent treatment. The illustrated degree of flare is about 10° conically relative to the axis; at least about 5° is desirable, and upwards of 15° can be useful. If desired, similar openings in the wall of intermediate portion 32** may be employed, but preferentially the openings and the flaring co-occur for the most part.

Operation of the illustrated apparatus in the practice of the present invention is readily understood. Textile strand 10 is withdrawn from package 11 or any other suitable source of supply of such strand and is passed through guide 12 or other appropriate guide, which imposes some degree of tension. Input godet and separator roll pair 13, 13' about which the strand passes in essentially non-slipping contact, establish a given input speed, which is normally exceeded by the speed of output godet and separator roll pair 15, 15' about which the strand passes similarly. In the event of a sufficient disparity between input and output speeds the strand is drawn to increased length, for which a ratio of 4X is customary in the treatment of nylon strands, for example. Crimping preferably follows closely after drawing.

The rate at which resulting strand 10' enters nip-jet stuffer-crimper 28 is at least the rate at which it leaves the output godet and separator roll pair and preferably is higher. At least one of nip rolls 16, 16' is driven, and the surface speed thereof is regulated relative to that of output draw roll 15, by conventional means (not shown), much as the speed of the output draw roll is controlled relative to that of the input draw roll, but with a lesser degree of underfeed in the downstream direction.

At greater than about ten percent roll overspeed, corresponding to strand underfeed, the strands probably will be drawn to further increased length, unless a maximum draw for the particular strand composition already had been imposed, and such further draw may equal or even exceed the previous draw if desired. It is preferred, although not necessary, that the strands not have been drawn significantly at a remote previous time, although appreciable benefit from the present invention may be attained if such previous draw did not exceed about half the total drawability of the undrawn material, thereby leaving it still substantially drawable. It is preferred to limit the degree of underfeed from rolls 15, 15' to the crimper to at most half the total drawing underfeed, or usually to not much more than about 200%. A range of from about 5 to 50% underfeed is preferred when little or no added draw is desired, and a range of from about 100 to 200% when substantial added draw is desired at the crimper input.

Air at superatmospheric pressure enters through tubes 17, 17' of the air jet means, then entrains and forwards (or at least assists in forwarding) the infed strand into and through entrance portion 31 in which it is compacted into accumulation **10*a* of crimped strand. The inside wall of the entrance or crimping portion of the laterally confining chamber is smoothly cylindrical and imperforate, the intermediate portion is stepped cylindrical and imperforate, and the exit portion is perforate and flared smoothly outward. As shown, the intermediate portion is preferably multiply stepped outward in the downstream direction. In addition thereto or instead thereof it may be tapered similarly. Transition steps or taper may occur at the junctions of succeeding portions with one another and at the outlet end of the exit portion. The propelling air pressure is relieved gradually by such increasing cross-section of the chamber bore and further by escaping in a sort of diffusion through the sidewall openings in flared exit portion 34 as well as flowing out the outlet 35** thereof, which is greatly enlarged over the intermediate portion.

Openings 36 from the interior to the exterior of exit portion 34 of the stuffing chamber are shown as small radial bores through the wall thereof. As indicated above, such a structure is considered to be a screen, in view of the fineness of the openings. Of course, a similarly fine woven screen is suitable also. A representative 60 mesh screen useful according to this invention has wire and opening widths of 0.008 or 0.009 inch, and the openings comprise about 30% of the screen area. A surface with such fine openings appears to have an overall matte finish rather than discrete openings therein, the individual openings being invisible to the unaided eye. The number of openings per unit area need not be uniform but may diminish in density (increase in spacing) toward the outlet, e.g., along equiangular lines as in FIG. 3.

Figure 5:
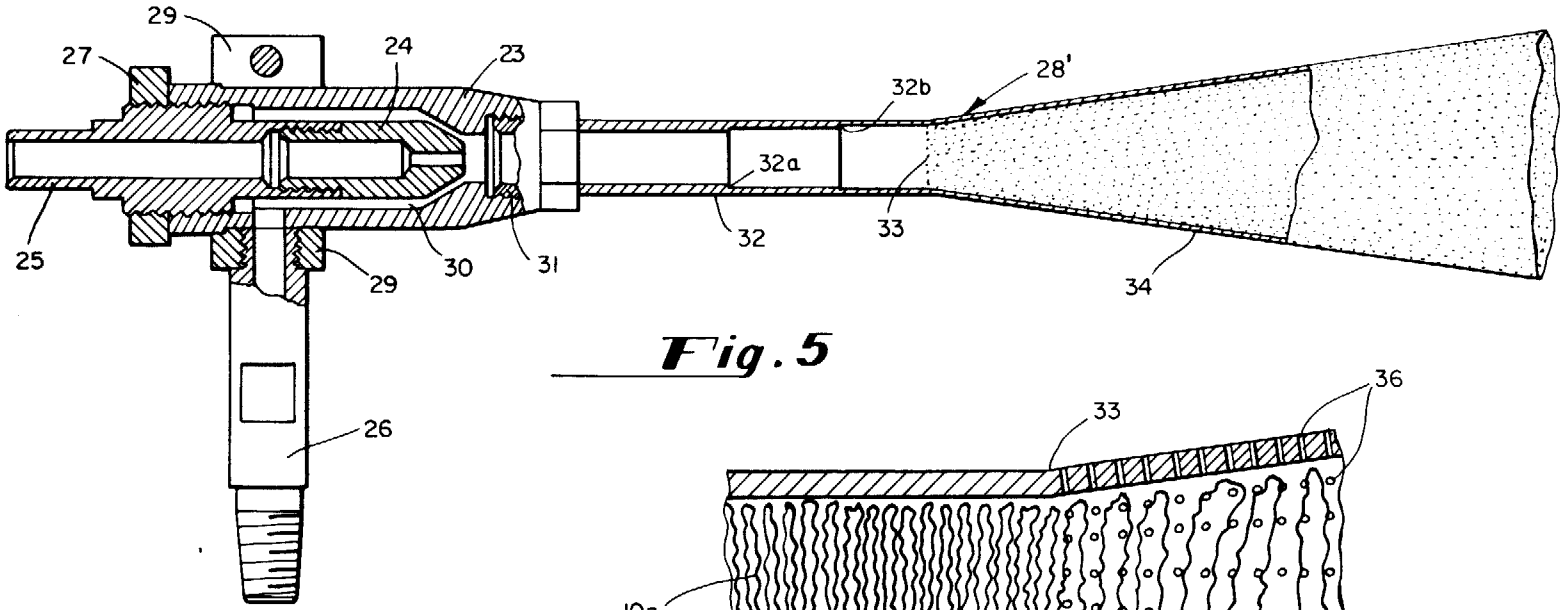
FIG. 5 is a side elevation, similar to FIG. 2 of a modified embodiment.

FIG. 5 shows modified stuffer crimper 28', which differs from stuffer crimper 28 of the preceding views by elimination of the nip rolls and reliance instead upon injection of air (or other fluid) to feed the strand thereinto as well as to forward it along once therein. Air at superatmospheric pressure enters through air inlet means 26 and passes through channel 30 past the outlet end of jet means 24. The venturi there established forwards strand into and through strand inlet means 25 and jet means 24 and on into and part of the way through chamber entrance portion 32 in which it is compacted into accumulation **10*a*** of crimped strand. The inside wall of the entrance portion of the chamber is smoothly cylindrical and imperforate, the intermediate portion is stepped cylindrical and imperforate, and the exit portion is perforate and flared smoothly outward as in the previous embodiment.

Figure 6:
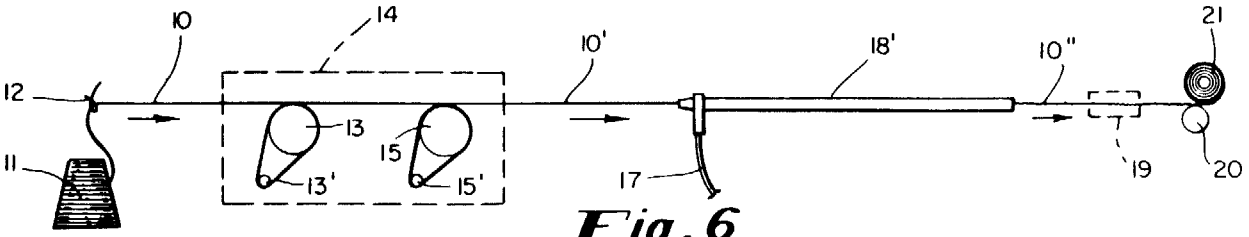
FIG. 6 is a schematic representation of the modified embodiment of FIG. 5, otherwise similar to FIG. 1.

In FIG. 6 schematically illustrated stuffer crimper 18' differs from stuffer crimper 28' of FIG. 5 as stuffer crimper 18 of FIG. 1 differs from that of FIGS. 2 to 4: simplified in showing by omission of the flared outlet screen. Because of the similarities, further discussion of this view is omitted in the interest of economy.

Suitable means and methods for heating the strand, as in enclosure 14, are set forth in U.S. Pat. No. 3,559,254 and my prior patents recited therein. Appropriate tensioning means are set forth in my U.S. Pat. No. 3,317,977 and its predecessor. Stuffing chambers for use according to this invention preferably are invariably of open-ended type as disclosed in U.S. Pat. No. 3,570,084 and my prior patents identified therein. For drawing means, see U.S. Pat. No. 3,570,083 and its predecessors in my name. Means for withdrawing crimped strand from the chamber and through the aftertreating enclosure have been shown schematically and may be wholly conventional.

The stuffer-crimper of this invention not only provides a novel combination of structural characteristics but also functions to produce crimped textile strands having superior qualities of handle, cover, and structural crimp characteristics. Such crimped strands are free of undesired degradation and loops. Although a preferred embodiment and a single modification have been described and illustrated, other modifications may be made therein, as by addition, combination, or subdivision of parts or steps, or by substitution of equivalents, while retaining significant advantages and benefits of the invention, which itself is defined in the following claims.

I claim:

1. In apparatus for crimping a textile strand by longitudinal compression, having an entrance and an open exit for such strand and having means laterally confining the strand for forwarding therebetween including successive entrance, intermediate, and exit portions, and means for injecting fluid into the entrance portion for use in forwarding such strand, the improvement wherein the exit portion is rigid and comprises a laterally surrounding fine screen having a flared outlet portion.

2. Strand-crimping apparatus according to claim 1, wherein the fluid-injection means is the sole means for feeding strand into the entrance portion.

3. Strand-crimping apparatus according to claim 1, including at the entrance end nip rolls between which strand fed into the entrance end passes.

4. Strand-crimping apparatus according to claim 3, wherein the injecting means includes a plurality of jets obliquely downstream oriented.

5. In stuffer-crimping apparatus for textile strands, having a laterally confining stuffing chamber and jet means for feeding strand thereinto and forwarding it at least partially therethrough, the improvement comprising an outwardly flaring circumferential screen constituting a rigid closure-free terminal portion of the chamber.

6. Strand-crimping apparatus according to claim 5, wherein the screen has openings so fine as to be individually invisible to the unaided eye and collectively perceptible as a matte finish thereof.

* * * * *